US009174788B2

(12) United States Patent
Liao

(10) Patent No.: US 9,174,788 B2
(45) Date of Patent: Nov. 3, 2015

(54) BUFFERING CUSHION WITH SUSPENDING LAYER HUNG BETWEEN INWARD-BENT AIR COLUMNS

(71) Applicant: Yaw-Shin Liao, Taipei (TW)

(72) Inventor: Yaw-Shin Liao, Taipei (TW)

( * ) Notice: Subject to any disclaimer, the term of this patent is extended or adjusted under 35 U.S.C. 154(b) by 0 days.

(21) Appl. No.: 14/215,082

(22) Filed: Mar. 17, 2014

(65) Prior Publication Data

US 2015/0259121 A1 Sep. 17, 2015

(51) Int. Cl.
*B65D 81/02* (2006.01)
*B65D 81/05* (2006.01)

(52) U.S. Cl.
CPC ..... *B65D 81/05* (2013.01)

(58) Field of Classification Search
CPC combination set(s) only.
See application file for complete search history.

(56) References Cited

U.S. PATENT DOCUMENTS

| | | | | |
|---|---|---|---|---|
| 7,066,331 | B2 * | 6/2006 | Koyanagi et al. | 206/522 |
| 2007/0051655 | A1 * | 3/2007 | Yoshifusa | 206/522 |
| 2007/0051656 | A1 * | 3/2007 | Hsin | 206/522 |
| 2007/0295633 | A1 * | 12/2007 | Liao et al. | 206/522 |
| 2009/0188830 | A1 * | 7/2009 | Liao et al. | 206/522 |
| 2013/0048529 | A1 * | 2/2013 | Liao et al. | 206/522 |

* cited by examiner

*Primary Examiner* — Jacob K Ackun
(74) *Attorney, Agent, or Firm* — Rabin & Berdo, P.C.

(57) ABSTRACT

A buffering cushion with a suspending layer hung between inward-bent air columns is provided. The quick-inflatable buffering cushion includes a first buffering member, a second buffering member, a third buffering member, a pair of vertical walls and a suspending layer. The second and third buffering members are bent to form a rectangular casing that has one pend end and a U-like sectional shape. A hammock-like suspending layer is integratedly extended from ends of the vertical walls for carrying an external object while providing buffering protection. The vertical walls form together with the second and third buffering member dual lateral buffering protection, respectively. The suspending layer is a non-inflatable piece, and thus is unlikely to be punctured by a sharp portion of the external object. Thereby, the external object is well protected in all directions by the buffering cushion and secured from damage during transport.

8 Claims, 7 Drawing Sheets

BUFFERING CUSHION WITH SUSPENDING LAYER HUNG BETWEEN INWARD-BENT AIR COLUMNS

BACKGROUND OF THE INVENTION

1. Technical Field

The present invention relates to buffering cushions for packaging, and more particularly to a buffering cushion with a suspending layer hung between inward-bent air columns, wherein the air columns can be inflated quickly and the suspending layer is hung between the inward-bent air columns.

2. Description of Related Art

With the vigorous development of the technical industry, electronic and telecommunication products, such as smart phones, tablet computers and flat LCD TV sets, become more and more exquisite in terms of structure. For ensuring the integrity of these products throughout their packing, transport and delivery, packaging materials play an important role. In early days, foam and other soft, loose material were placed in cartons for providing buffering protection. However, their effects are limited as they are unable to be uniformly arranged and they tend to scatter around.

For overcoming the foregoing shortcomings, some packaging dealers started to use an inflatable air pack as cushioning material. Such an inflatable air pack has a piece-like shape constructed from a plurality of air columns, and is to be placed around an object to be protected or filled in a packaging box. However, one air pack can only protect one side of the object, and in order to achieve all-around protection, many of such air packs have to be used simultaneously. This nevertheless means troublesome installing operation. Furthermore, since the air packs are independent of each other, they tend to have displacement after the foregoing time-consuming installation. One more defect of the known air packs is that as they are in nature inflated thin-film bubbles, when directly contacting an object to be protected, the sharp portion of the object or its other packaging material, such as binding needles, can easily puncture the film-made air packs. Particularly, at the bottom of the object to be protected, the punctured air packs can soon lose air and become functionless. If such puncture happens during transport and the broken air packs cannot be replaced timely, the object losing protection is put in high risk of damage.

In view of this, there is a need of an air pack that is unlikely to be punctured by sharp things and provides all-around buffering protection.

SUMMARY OF THE INVENTION

One objective of the present invention is to provide an inflatable rectangular cushion body that has a U-like sectional shape for receiving and fully protecting an external object with its buffering capability.

Another objective of the present invention is to provide a buffering cushion with a suspending layer hung between inward-bent air columns, wherein the suspending layer is less likely to be punctured as compared to inflated parts of the buffering cushion, such as the air columns.

To achieve the foregoing objectives, the disclosed buffering cushion with the suspending layer hung between the inward-bent air columns comprises: A buffering cushion with a suspending layer hung between inward-bent air columns, the buffering cushion being made of at least two outer films and comprising: a first buffering member, including a plurality of said air columns arranged abreast, wherein each said air column has each of two opposite sides thereof formed with a heat-seal line that binds the two outer films together, and has each of two opposite ends thereof formed with a joint through heat sealing; a second buffering member, extended from one side of the first buffering member and including a plurality of inflatable wall columns that are connected to the air columns of the first buffering member via the joints, so that the second buffering member is allowed to be bent inward against the joints, and the second buffering member has one side opposite to the first buffering member formed with a connecting heat-seal border for connecting the inflatable wall columns through heat sealing; a third buffering member, extended from one side of the first buffering member opposite to the second buffering member and including a plurality of inflatable wall columns that are connected to the air columns of the first buffering member via the joints, so that the third buffering member is allowed to be bent inward against the joints, and the third buffering member has one side opposite to the first buffering member formed with a connecting heat-seal border, in which at least one air channel is arranged between the first buffering member and each of the second and third buffering members so that an inflating air flow is allowed to flow through the first, second and third buffering member; and the suspending layer, connecting the connecting heat-seal borders of the second buffering member and the third buffering member, and forming together with the second buffering member and the third buffering member an accommodating space opened outward, wherein the suspending layer has each of two sides thereof provided with an extended portion, with one said extended portion integratedly extended from the connecting heat-seal border of the second buffering member and the other said extended portion integratedly extended from the connecting heat-seal border of the third buffering member, and the two extended portions are heat sealed together to form a suspending portion substantially located at a center of the accommodating space, whereby the suspending layer serves to carry an external object, and forms together with the first, second and third buffering members a cushion body of the buffering cushion, for providing the external object with buffering protection, in which one end of the cushion body is formed with an end opening communicated with the accommodating space.

According to one preferred embodiment of the present invention, each of the second buffering member and the third buffering member has a plurality of aligned bent sections formed through heat sealing, and a vertical wall is formed between the connecting heat-seal border of each of the second buffering member and the third buffering member and the corresponding bent sections, so that the vertical walls are allowed to be bent in toward the accommodating space against the bent sections, in which each said vertical wall comprises plural said inflatable wall columns, and in which what is between the bent sections of each of the second and third buffering members and the joints of the first buffering member is defined as a supporting portion, and each said vertical wall has a height smaller than a height of the supporting portion.

The disclosed buffering cushion can be inflated quickly into a buffering protecting structure. The bent second and third buffering members form the vertical walls, and the non-inflatable suspending layer is formed at ends of the vertical walls for carrying an external object. Thereby the second and third buffering members and the vertical walls provide lateral protection, while at the bottom of the external object the suspending layer and the first buffering member provide bearing and buffering, respectively. Thereby, the external object is protected by the disclosed buffering cushion in all directions and this full buffering protection secures the external object from damage during transport. Furthermore, since the suspending layer is designed to prevent the first buffering member and itself being punctured by any sharp parts of the external object, the function of the buffering cushion is ensured.

DETAILED DESCRIPTION OF THE INVENTION

Figure 1:
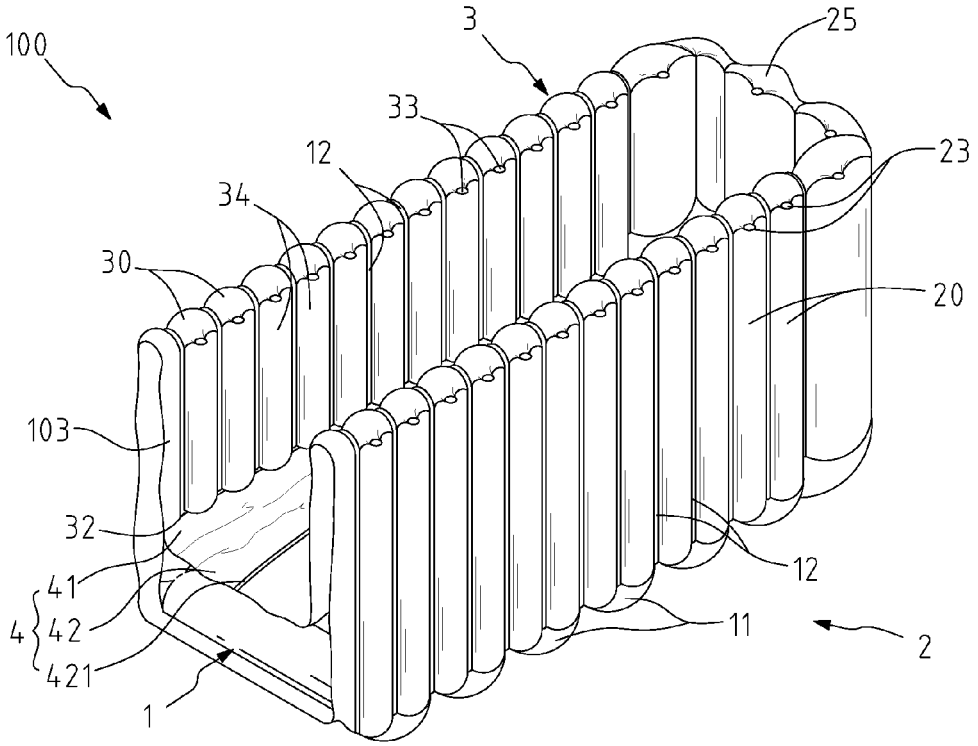
FIG. 1 is a perspective view of a buffering cushion with a suspending layer hung between inward-bent air columns according to one preferred embodiment of the present invention.

The present invention discloses a buffering cushion with a suspending layer hung between inward-bent air columns, which can be inflated quickly and is a rectangular casing with one or two end-openings and a U-like sectional shape formed by bending inflatable air columns. The buffering cushion contains therein the suspending layer for carrying and providing an external object with buffering protection. The suspending layer is a non-inflatable piece, so is unlikely to be punctured by any sharp parts of the external object. Furthermore, one or more said buffering cushions can be used simultaneously to jointly protect the external object in all directions.

Referring to FIG. 1 through FIG. 4, in one preferred embodiment of the present invention, a buffering cushion 100 is made from two plastic outer films 101 and 102. The buffering cushion 100 comprises: a first buffering member 1, a second buffering member 2, a third buffering member 3, a pair of vertical walls 24 and 34, and a suspending layer 4. The first buffering member 1 includes a plurality of arranged abreast air columns 11. Each of the air columns 11 has each of its opposite two sides formed with a heat-seal line 12 that binds the two outer films, and has each of its opposite two ends formed with a joint 13 through heat sealing.

Figure 2:
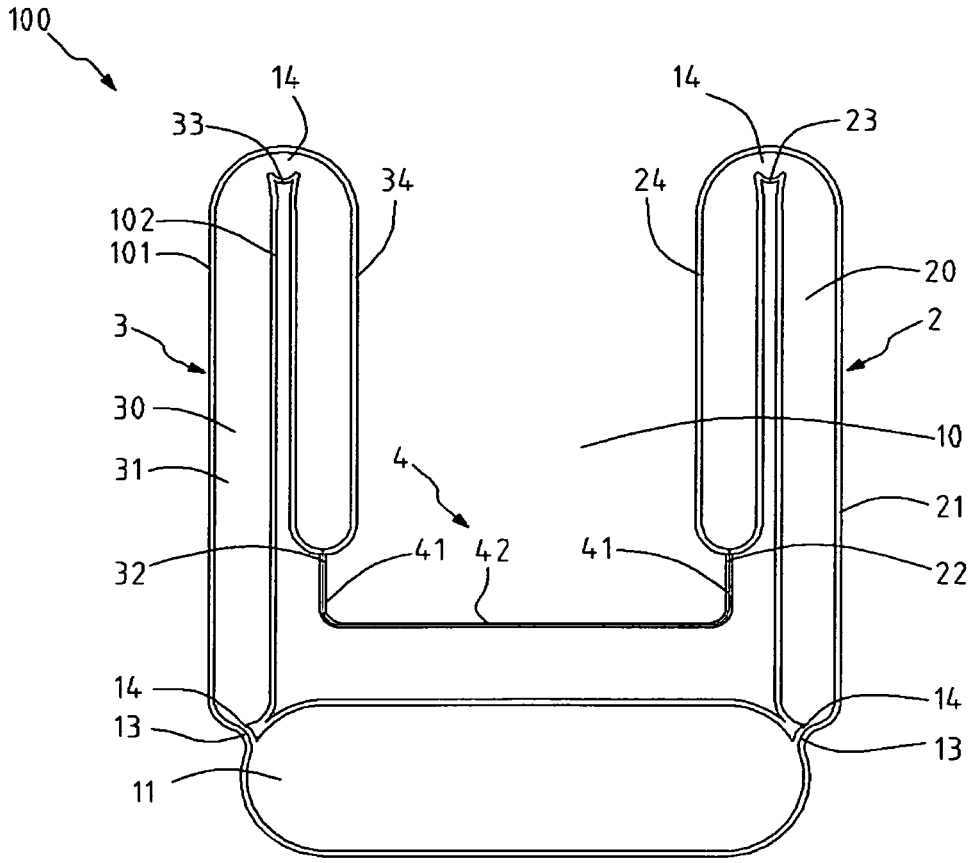
FIG. 2 is a cross-sectional view of the buffering cushion of FIG. 1.
Figure 3:
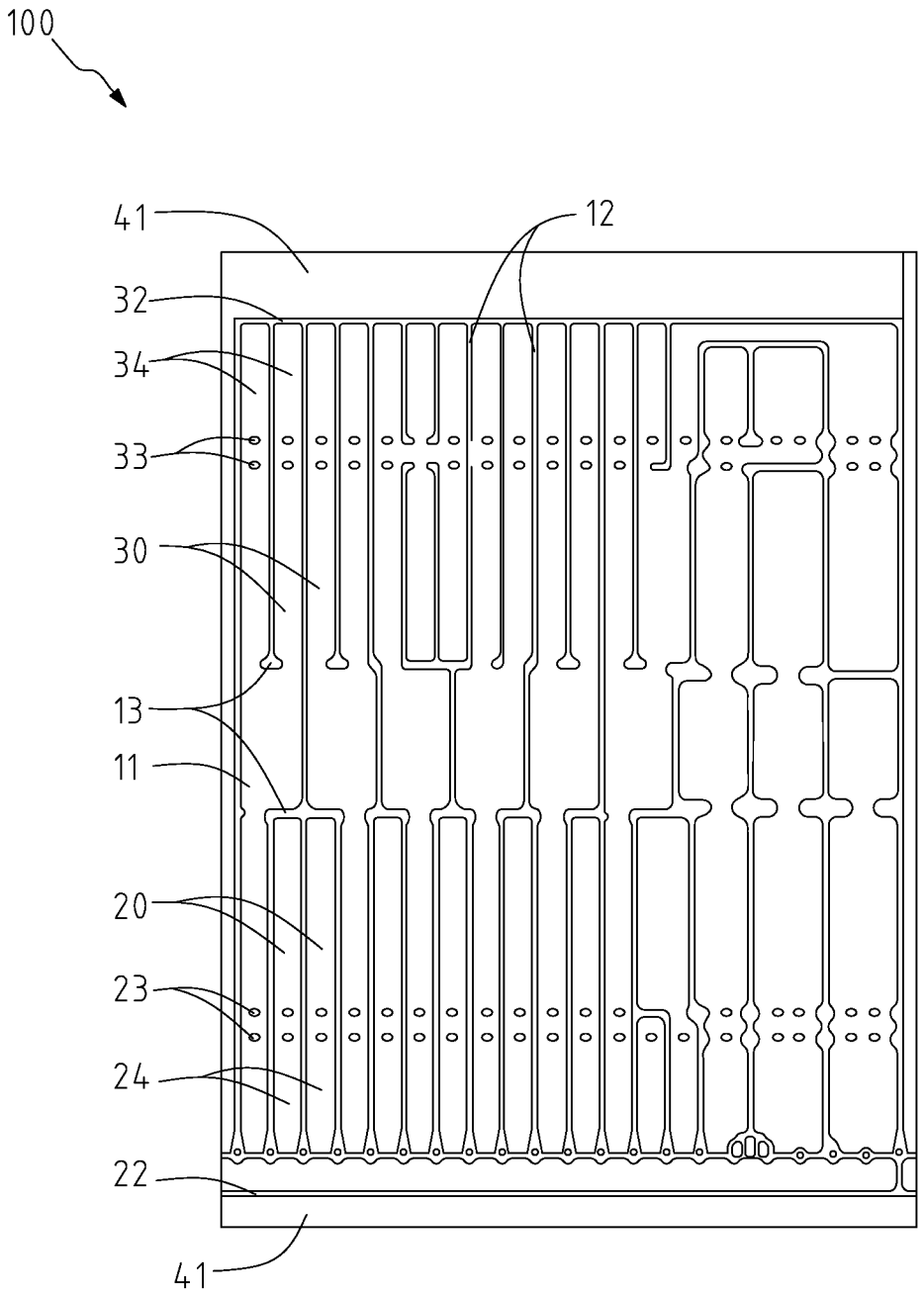
FIG. 3 is an expanded view of the buffering cushion of FIG. 1.

The second buffering member 2 is extended from one side of the first buffering member 1, and includes a plurality of inflatable wall columns 20. Each of the inflatable wall columns 20 has each of its opposite two sides formed with the heat-seal line 12, and is connected to the air column 11 of the first buffering member 1 via the joint 13, so that the second buffering member 2 is allowed to be bent inward against the joints 13. The second buffering member 2 at its side opposite to the first buffering member 1 has a connecting heat-seal border 22, for connecting the inflatable wall columns 20 through heat sealing. In other words, the connecting heat-seal border 22 is located at the extreme of the second buffering member 2. In addition, the second buffering member 2 has a plurality of aligned bent sections 23 formed through heat sealing. The bent sections 23 may be arranged into one or mow rows, with the attempt to allow the second buffering member 2 to be bent thereon. Therefore, the bending angle of the second buffering member 2 is determined by the size of the bent sections 23. Each of the bent sections 23 is corresponding to one said inflatable wall column 20. The bent sections 23 and heat-seal lines 12 of the inflatable wall column 20 are alternatively arranged, so as to form air channels 14 (as shown in FIG. 2) not sealed for allowing an air flow to flow from the first buffering member 1 to the second buffering member 2.

The third buffering member 3 is extended from the other side of the first buffering member 1, and includes a plurality of inflatable wall columns 30. Each of the inflatable wall columns 30 has its opposite two sides sealed with the heat-seal lines 12 and connected to the air columns 11 of the first buffering member 1 via the joints 13, so that the third buffering member 2 is allowed to be bent inward against the joints 13. The third buffering member 3 at its side opposite to the first buffering member 1 has a connecting heat-seal border 32, for connecting the inflatable wall columns 30 through heat sealing. In other words, the connecting heat-seal border 32 is at the extreme of the third buffering member 3. The third buffering member 3 further has a plurality of aligned bent sections 33 formed through heat sealing. The bent sections 33 may be arranged into one or more rows, with the attempt to allow the third buffering member 3 to be bent thereon. Therefore, the bending angle of the third buffering member 3 is determined by the size of the bent section 33. Each of the bent sections 33 is corresponding to one said inflatable wall column 30. The bent sections 33 and heat-seal lines 12 of the inflatable wall column 30 are alternatively arranged, so as to form air channels 14 (as shown in FIG. 2) not sealed for allowing an air flow to flow from the first buffering member 1 to the third buffering member 3.

On the first buffering member 1, the second buffering member 2 and the third buffering member 3, there are plural air channels 14 formed between the air column 11 and the inflatable wall columns 20 and 30, so that an inflating air flow is allowed to flow through the first buffering member 1 and the second buffering member 2 and the third buffering member 3.

The vertical walls 24 and 34 are formed between the connecting heat-seal borders 22 and 32 of the second buffering member 2 and the third buffering member 3 and the bent sections, and are allowed to bent against the bent sections 23 and 33 toward an accommodating space 10 (as described below). Each of the vertical walls 24 and 34 comprises plural inflatable wall columns 20 or 30. Therein, what is between the bent sections 23 or 33 of the second buffering member 2 or the third buffering member 3 and the joints 13 of the first buffering member 1 is defined as a supporting portion 21 or 31. In other words, the second buffering member 2 is bent to form the vertical wall 24 and the supporting portion 21, and the third buffering member 3 is bent to form the vertical wall 34 and the supporting portion 31. Each of the vertical walls 24 and 34 has a height smaller than that of the supporting portion 21 or 31, and the bending angle of the vertical wall 24 or 34 is determined by the size of the bent sections 23 or 33.

Figure 4:
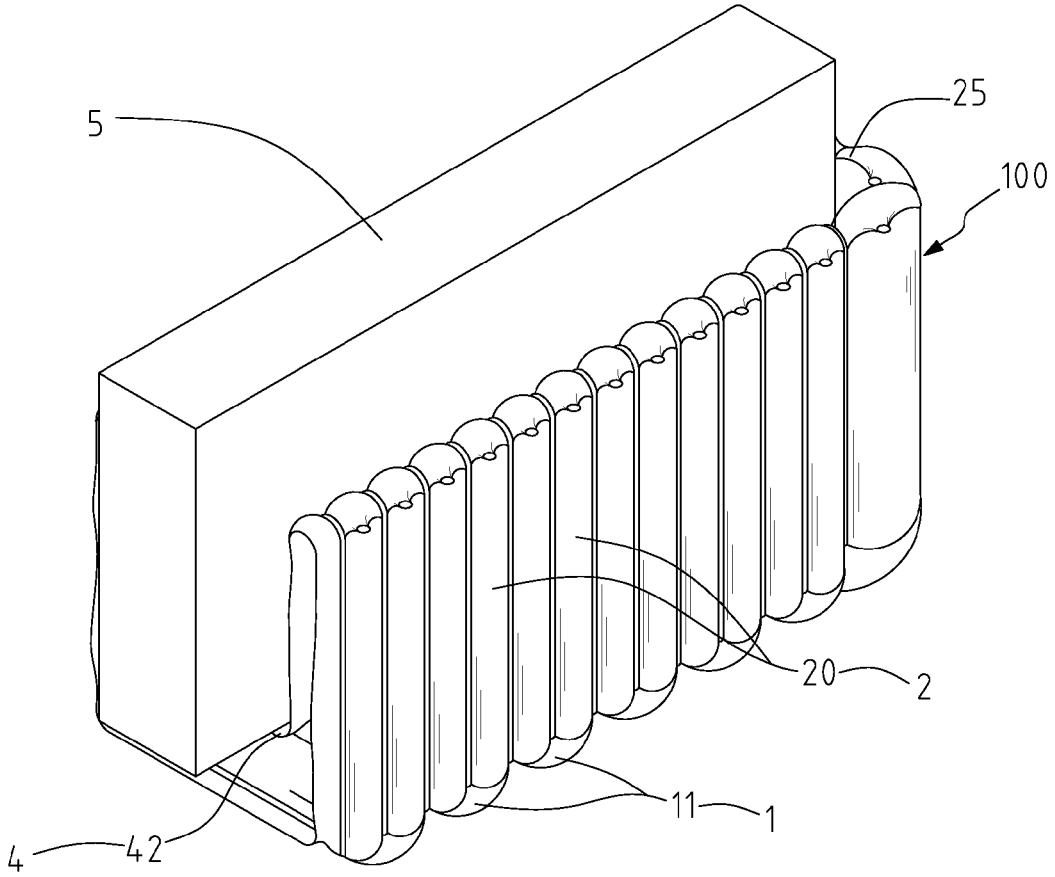
FIG. 4 is an applied view of the buffering cushion of FIG. 1 showing an external object received therein.

The suspending layer 4 connects the connecting heat-seal borders 22 and 32 of the second buffering member and the third buffering member 3, or, connects the extremes of the vertical walls 24 and 34, and forms together with the second buffering member 2 and the third buffering member 3 the accommodating space 10 open outward. The suspending layer 4 has its two opposite sides each formed with an extended portion 41. One of the extended portion 41 is integratedly extended from the connecting heat-seal border 22 of the second buffering member 2, and the other extended portion 41 is integratedly extended from the connecting heat-seal border 32 of the third buffering member 3. The two extended portions 41 are sealed together, and between the two extended portions 41 a suspending portion 42 is substantially located at the center of the accommodating space 10. The suspending portion 42 is separated from the air columns 11 of the first buffering member 1 by an interval. The suspending layer 4 serves to carry an external object 5 (as shown in FIG. 4), and forms together with the first, second and third buffering members 1, 2 and 3 a cushion body with the suspending layer. The interval between the suspending portion 42 and the first buffering member 1 further provides the external object 5 placed on the suspending portion 42 with a buffering space. Thereby, the disclosed buffering cushion 100 effectively provides buffering protection to the external object 5 with its inflatable parts, the suspending layer 4 and the intervals between the suspending layer 4 and the inflatable parts. In addition, the buffering cushion 100 has one end formed with an end opening 103 communicated with the accommodating space 10, for allowing the external object 5 to be placed into the accommodating space 10 through the end opening 103 or from above. Particularly, when carrying the external object 5, the suspending layer 4 receives dual support from the vertical walls 24 and 34 and the supporting portions 21 and 31, and can slightly sink due to the weight of the external object 5. Since the suspending layer is a non-inflatable piece, it is unlikely to be punctured by any sharp parts of the external object, thereby providing stable and safe support.

It is to be noted that the suspending layer 4 may be formed by laminating the two outer films 101 and 102, or may be formed by extending either of the two outer films 101 and 102 from the connecting heat-seal border 22 or 32 of the second or third buffering member 2 or 3.

Figure 6:
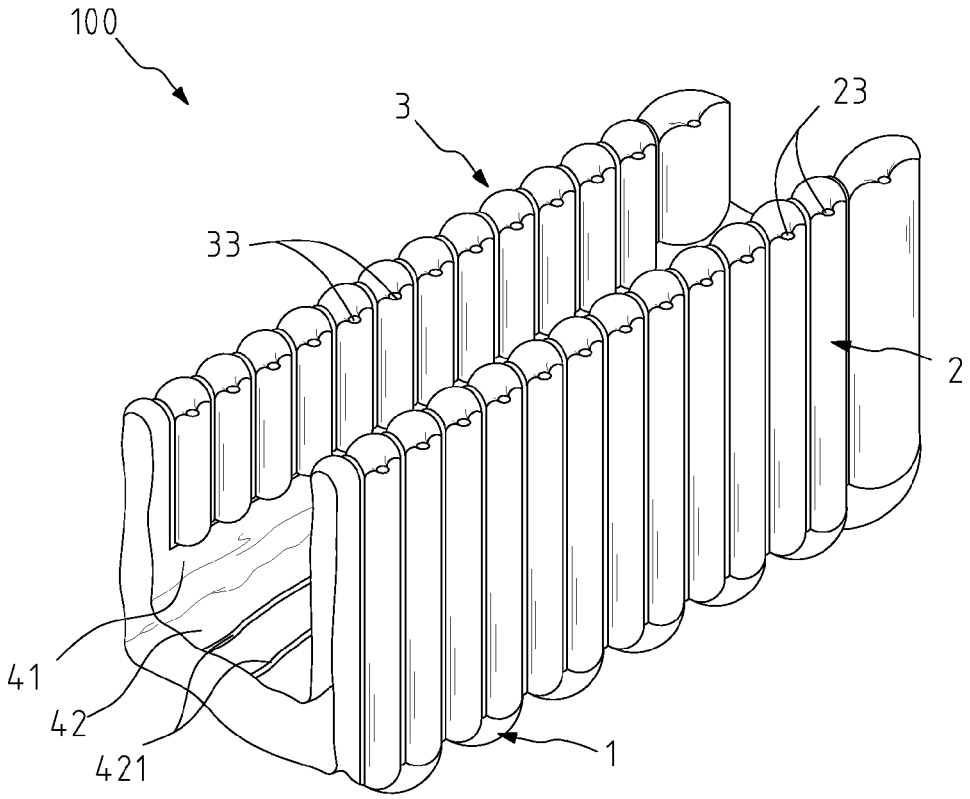
FIG. 6 is a perspective view of a buffering cushion with a suspending layer hung between inward-bent air columns according to another preferred embodiment of the present invention.

The suspending portion 42 of the suspending layer 4 further has an extended heat-seal border 421 (as shown in FIG. 6), which is extended rearward from the end opening 103, so as to enlarge the suspending portion 42 in terms of width, and in turn the overall width of the suspending layer 4. The width of the extended heat-seal border 421 may vary according to practical needs, so as to provide an adequate space for receiving the external object 5. Furthermore, as shown in FIG. 6, the second buffering member 2 and the third buffering member 3 have different heights, so that external objects of different shapes can be easily put sideways into the accommodating space 10 from the top of the third buffering member 3.

Figure 5:
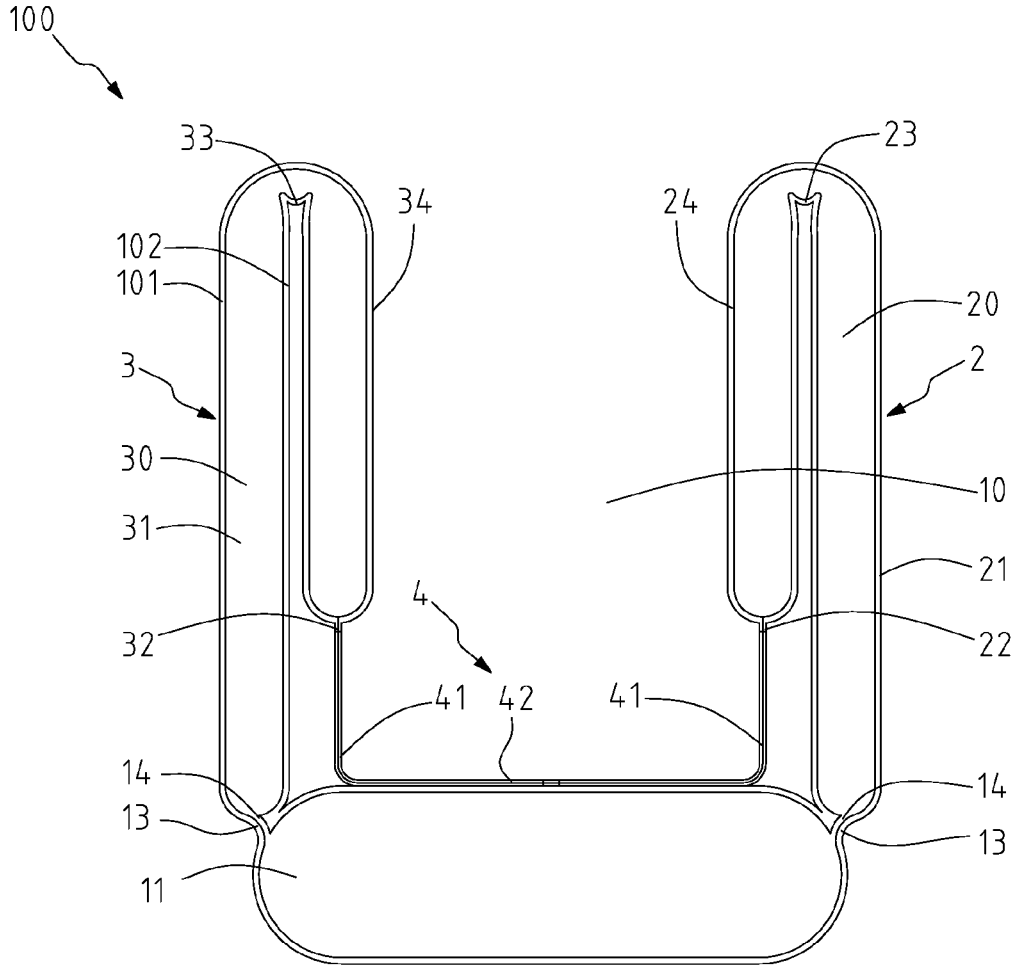
FIG. 5 is a cross-sectional view of a buffering cushion with a suspending layer hung between inward-bent air columns according to another preferred embodiment of the present invention.

Referring to FIG. 5 for another embodiment of the present invention, the suspending portion 42 of the suspending layer 4 is heat sealed onto the first buffering member 1, so that the air columns 11 of the first buffering member 1 provide the external object 5 with butter buffering protection. Since the suspending layer 4 is above the first buffering member 1, the first buffering member is protected from being punctured by any sharp parts of the external object 5.

Referring back to FIG. 1, the second buffering member 2 and the third buffering member 3 have their sides opposite to the end opening 103 extended with plural inflatable wall columns 20 and 30 that are heat sealed together to form a retaining wall 24. The retaining wall 24 serves to position the external object 5 from its rear end (as shown in FIG. 4).

Figure 7:
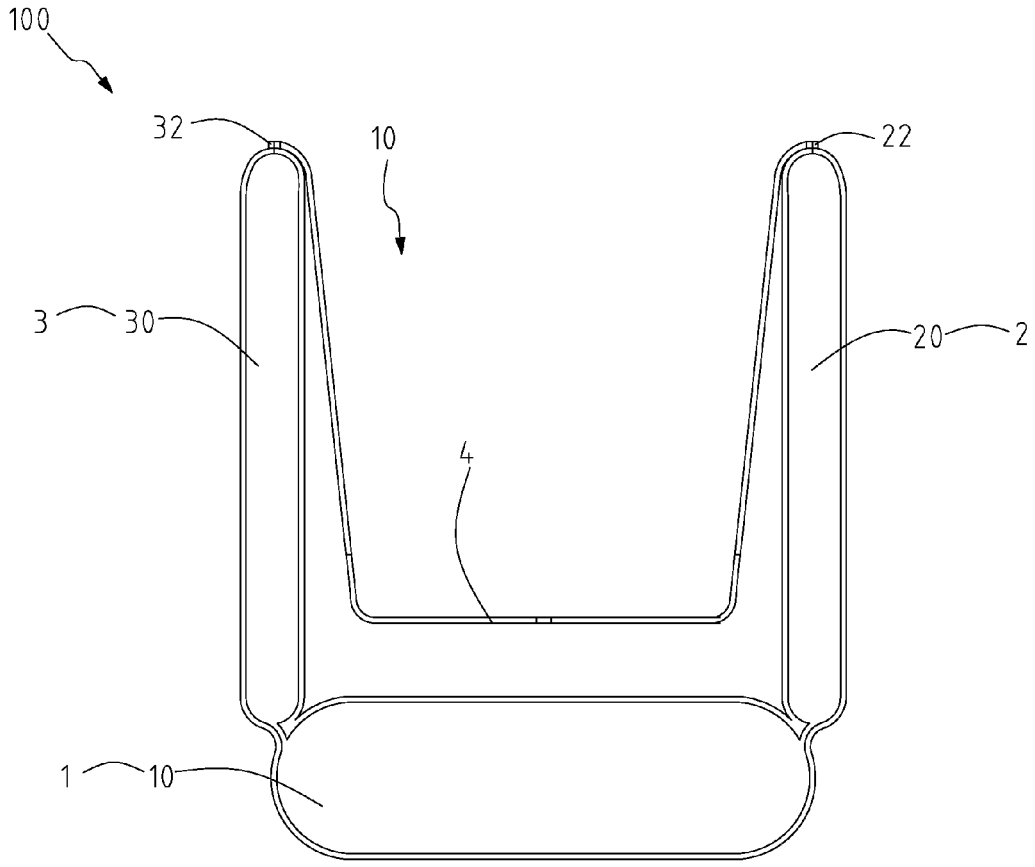
FIG. 7 is a cross-sectional view of a buffering cushion with a suspending layer hung between inward-bent air columns according to another preferred embodiment of the present invention.

Please refer to FIG. 7 for another embodiment of the present invention. Therein, the buffering cushion 100 has unbent second and third buffering members 2 and 3, meaning that there is no any vertical walls 24 and 34 as described above. The suspending layer 4 is directly extended from the connecting heat-seal borders 22 and 32 at the extremes of the second and third buffering members 2 and 3 as an integral member. In this way, the buffering cushion 100 can also use the suspending layer 4 to carry the external object 5 while providing buffering protection.

To sum up, the disclosed buffering cushion 100 can be inflated quickly into a buffering protecting structure. The bent second and third buffering members 2 and 3 form the vertical walls 24 and 34, and the non-inflatable suspending layer 4 is formed at ends of the vertical walls 24 and 34 for carrying an external object 5. Thereby the second and third buffering members 2 and 3 and the vertical walls 24 and 34 provide lateral protection, while at the bottom of the external object 5 the suspending layer 4 and the first buffering member 1 provide bearing and buffering, respectively. Thereby, the external object 5 is protected by the disclosed buffering cushion 100 in all directions and this full buffering protection secures the external object from damage during transport. Furthermore, the suspending layer 4 is designed to prevent the first buffering member 1 and itself being punctured and losing the protective function. The buffering cushion 100 is easy to manufacture and is cost-effective in use. Also, plural said buffering cushions 100 can be used together to ensure better protection.

What is claimed is:

1. A buffering cushion with a suspending layer hung between inward-bent air columns, the buffering cushion being made of at least two outer films and comprising:

a first buffering member, including a plurality of said air columns arranged abreast, wherein each said air column has each of two opposite sides thereof formed with a heat-seal line that binds the two outer films together, and has each of two opposite ends thereof formed with a joint through heat sealing;

a second buffering member, extended from one side of the first buffering member and including a plurality of inflatable wall columns that are connected to the air columns of the first buffering member via the joints, so that the second buffering member is allowed to be bent inward against the joints, and the second buffering member has one side opposite to the first buffering member formed with a connecting heat-seal border for connecting the inflatable wall columns through heat sealing;

a third buffering member, extended from one side of the first buffering member opposite to the second buffering member and including a plurality of inflatable wall columns that are connected to the air columns of the first buffering member via the joints, so that the third buffering member is allowed to be bent inward against the joints, and the third buffering member has one side opposite to the first buffering member formed with a connecting heat-seal border, in which at least one air channel is arranged between the first buffering member and each of the second and third buffering members so that an inflating air flow is allowed to flow through the first, second and third buffering member; and the suspending layer, connecting the connecting heat-seal borders of the second buffering member and the third buffering member, and forming together with the second buffering member and the third buffering member an accommodating space opened outward, wherein the suspending layer has each of two sides thereof provided with an extended portion, with one said extended portion integratedly extended from the connecting heat-seal border of the second buffering member and the other said extended portion integratedly extended from the connecting heat-seal border of the third buffering member, and the two extended portions are heat sealed together to form a suspending portion substantially located at a center of the accommodating space, whereby the suspending layer serves to carry an external object, and forms together with the first, second and third buffering members a cushion body of the buffering cushion, for providing the external object with buffering protection, in which one end of the cushion body is formed with an end opening communicated with the accommodating space;

wherein each of the second buffering member and the third buffering member has a plurality of aligned bent sections formed through heat sealing, and a vertical wall is formed between the connecting heat-seal border of each of the second buffering member and the third buffering member and the corresponding bent sections, so that the vertical walls are allowed to be bent in toward the accommodating space against the bent sections, in which each said vertical wall comprises plural said inflatable wall columns, and in which what is between the bent sections of each of the second and third buffering members and the joints of the first buffering member is defined as a supporting portion, and each said vertical wall has a height smaller than a height of the supporting portion.

2. The buffering cushion of claim 1, wherein the suspending portion of the suspending layer further has at least one extended heat-seal border that is extended rearward from the end opening, for enlarging the suspending portion in width and providing adequate space for receiving the external object.

3. The buffering cushion of claim 1, wherein when the accommodating space does not contain the external object, the suspending layer and the first buffering member are separated by an interval.

4. The buffering cushion of claim 1, wherein the suspending portion of the suspending layer is heat sealed onto the first buffering member.

5. The buffering cushion of claim 1, wherein the two outer films are made of plastic, and the suspending layer is formed by laminating the two outer films together, or by extending either of the two outer films outward from the connecting heat-seal border of the second buffering member or the third buffering member.

6. The buffering cushion of claim 1, wherein the second buffering member and the third buffering member are different in terms of height, so that the external object is to be put sideways into the accommodating space from a top of the second buffering member or the third buffering member.

7. The buffering cushion of claim 1, wherein each of the second buffering member and the third buffering member has one side opposite to the end opening extended with more inflatable wall columns, and the inflatable wall columns of the buffering members are heat sealed to form an integrated retaining wall.

8. The buffering cushion of claim 1, wherein the bent sections and heat-seal lines of the inflatable wall columns of the second and third buffering members are alternatively arranged, so as to form air channels not sealed for allowing an air flow to flow from the first buffering member to the second and third buffering members.

* * * * *